US006336819B1

(12) United States Patent
Ishii et al.

(10) Patent No.: US 6,336,819 B1
(45) Date of Patent: Jan. 8, 2002

(54) ELECTRONIC APPARATUS HAVING CONNECTOR REMOVAL PREVENTING DEVICE

(75) Inventors: Mitsuharu Ishii; Toshitaka Aoki; Norio Koyanagi, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/518,138

(22) Filed: Mar. 3, 2000

(30) Foreign Application Priority Data

May 26, 1999 (JP) ..... 11-146371

(51) Int. Cl.[7] ..... H01R 13/44
(52) U.S. Cl. ..... 439/147
(58) Field of Search ..... 439/135, 144, 439/147, 345, 304, 367, 911

(56) References Cited

U.S. PATENT DOCUMENTS 3,499,102 A * 3/1970 Gillemot et al. ..... 174/138 F
3,602,659 A * 8/1971 Walter et al. ..... 200/50.1
4,327,953 A * 5/1982 Slagel et al. ..... 439/71
4,530,555 A * 7/1985 South ..... 439/147
5,087,796 A * 2/1992 Norman ..... 174/67
5,199,898 A * 4/1993 Wisner ..... 439/367
5,338,211 A * 8/1994 Kodama et al. ..... 439/135
5,731,683 A * 3/1998 Nakanishi ..... 320/2
5,993,226 A * 11/1999 Yamaguchi ..... 439/157
6,127,639 A * 10/2000 Greco et al. ..... 200/293

FOREIGN PATENT DOCUMENTS

JP 5-327236 12/1993

* cited by examiner

*Primary Examiner*—Brian Sircus
*Assistant Examiner*—Thanh-Tam Le
(74) *Attorney, Agent, or Firm*—Staas & Halsey LLP

(57) ABSTRACT

An electronic apparatus including an apparatus body, a body-side connector, a cable-side connector capable of engaging the body-side connector and a connector housing provided in the apparatus body and having a space through which the cable-side connector can be guided from the outside so as to engage the body-side connector. A connector cover, detachably engaged with the apparatus body, is movable between an open position in which the connector cover can be removed and a closed position in which the connector housing is closed by the connector cover. The connector cover is provided with projections for preventing movement of the cable-side connector toward a disengaging direction thereof, to keep the cable-side connector engaged with the body-side connector in the closed position of the connector cover.

10 Claims, 4 Drawing Sheets

ELECTRONIC APPARATUS HAVING CONNECTOR REMOVAL PREVENTING DEVICE

BACKGROUND OF THE INVENTION

1. Field of the Invention

The present invention relates to an electronic apparatus and, more particularly, to an electronic apparatus having means for preventing a connector from being unintentionally removed from a body of the electronic apparatus, such as a computer, a bar-code scanner, a laser beam printer, of other similar apparatuses.

2. Description of the Related Art

In an electronic apparatus, such as a computer, a bar-code scanner or a laser beam printer or the similar apparatuses, when a connector cable is connected to a body of the electronic apparatus, a pin-jack connector is generally used. When the connector is connected to the body, mean for fixing the cable connector to the apparatus connector or to the body of the apparatus is usually used so as to prevent the cable connector from being loosed or unintentionally removed after the cable connector is first fitted to an apparatus connector.

Conventional methods for fixing the cable connector to the apparatus connector to prevent the connector from being unintentionally removed from the body are as follows.

In a hook-type one, the cable connector is provided with a hook which can be resiliently engaged with a hook adaptor of the apparatus connector to lock the cable connector to the body. When the connector is to be released, the hook is disengaged from the hook adaptor and then the cable connector is drawn from the apparatus body.

In a screw locking type one, the cable connector is provided with screws so that, after the cable connector is fitted with the apparatus connector, the screws are rotated by using a tool, such as a driver, to fasten the screws to the screw holes to fix the connector to the apparatus body.

In a connector removal preventing means as mentioned above, a space must be necessary around a connector engaging region in the apparatus body into which fingers of the operator can be inserted so as to conduct the locking or fixing operation. However, such requirements would affect the demands for smaller space and downsizing of the apparatus body.

In addition, even if the connectors are insufficiently fixed or locked, it is difficult for the operator to find such an insufficient situation under the usual assembling condition, sometimes, such an insufficient situation is found only after the operator turns on the power supply. In these situations, the power would be supplied even under the insufficient connecting condition, there might be a possibility to damage the apparatus.

SUMMARY OF THE INVENTION

An object of the present invention is to provide an electronic apparatus having means capable of preventing the connector from being unintentionally removed from a body of an apparatus, with a simple structure.

According to the present invention, there is provided an electronic apparatus: an apparatus body; a first connector fixed to the apparatus body with which, a second connector attached to a cable is to be engaged; and a connector housing provided in the apparatus body and having a wall to which the first connector is installed and a space in which the second connector can be accommodated; and a connector cover for closing the connector housing, the connector cover provided with projections for preventing the second connector to avoid the movement thereof toward a disengaging direction thereof to keep the second connector in its fitted condition with respect to the first connector.

According to the electronic apparatus of the present invention having a means for preventing the connector from being removed, a connector fitting operation can be performed in a relatively small space. Thus, in this invention, at the same time when the connector cover is attached to the apparatus body, the connector is locked by the projections of the connector cover. Therefore, in comparison with the prior art in which the connector is fixed to the apparatus body by using screws, according to the present invention, a space for inserting fingers or the like is no longer necessary, so that the size of the apparatus can be reduced. In this connection, according to the present invention, the degree of freedom for mounting or positioning the first connector can be increased.

In addition, according to the present invention, not only the connector is prevented from being unintentionally removed, the connector setting condition can be observed during the assembling operation and, therefore, any insufficient fitting of the connector can be avoided. That is to say, unless the cable-side connector is completely be fitted with the body-side connector, the projections of the connector cover are in contact with the connector and thus the connector cover itself can no longer be attached to the apparatus body. Failure of connector fitting can thus be avoided.

Further, according to the present invention, the time necessary for fitting of the connector can be reduced. Since the connector locking operation in the prior art uses screws or the like, a time to fixedly secure the connector to the apparatus body is necessary. However, according to the present invention, the time for fixedly securing the connector is no longer necessary, but simply attaching the connector cover to the apparatus body is sufficient, thereby reducing the time necessary for assembling.

In one embodiment, the connector cover is slidingly movable between the first position in which the connector cover can be removed from the apparatus body and a second, closed position in which the connector cover is locked to the apparatus body; and a sliding direction of the connector cover is different from a direction along which the second connector is inserted to the first connector.

In this case, if the connector or the cable associated with this connector is drawn, the connector comes into contact with the projections of the connector cover and, therefore, even if the cable is drawn in a direction toward which the cover is open, or a direction toward which the connector is disengaged, the connector is prevented from being removed.

In another embodiment, the connector cover is provided with at least two projections which are located at respective sides of the cable and spaced to each other by a distance larger than a sum of a diameter of the cable and a sliding width of the connector cover necessary for opening the connector cover.

In still another embodiment, the connector cover is elastically snap-locked when it is moved to the second position and the connector cover can be moved from the second position to the first position by forcedly moving the connector against the elastical snap locking.

In further embodiment, the apparatus body is provided with rails for slidingly supporting respective side edges of the connector cover; the connector cover is provided with projections and the rails are provided with ridges in such a manner that the projections are able to come over the ridges, so that the connector cover is locked at the second position and, when the connector cover is forcedly moved toward the first position, the projections come over the ridges to allow the connector cover move toward the first position.

According to another aspect of the present invention, there is provided an electronic apparatus: a first connector; a connector housing, to which the first connector is attached, for accommodating a second connector which is to be connected to the first connector; a connector cover for closing the connector housing; and the connector cover provided with projections for restricting the movement of the second connector in its fitting direction.

DETAILED DESCRIPTION OF THE EMBODIMENTS

Figure 1:
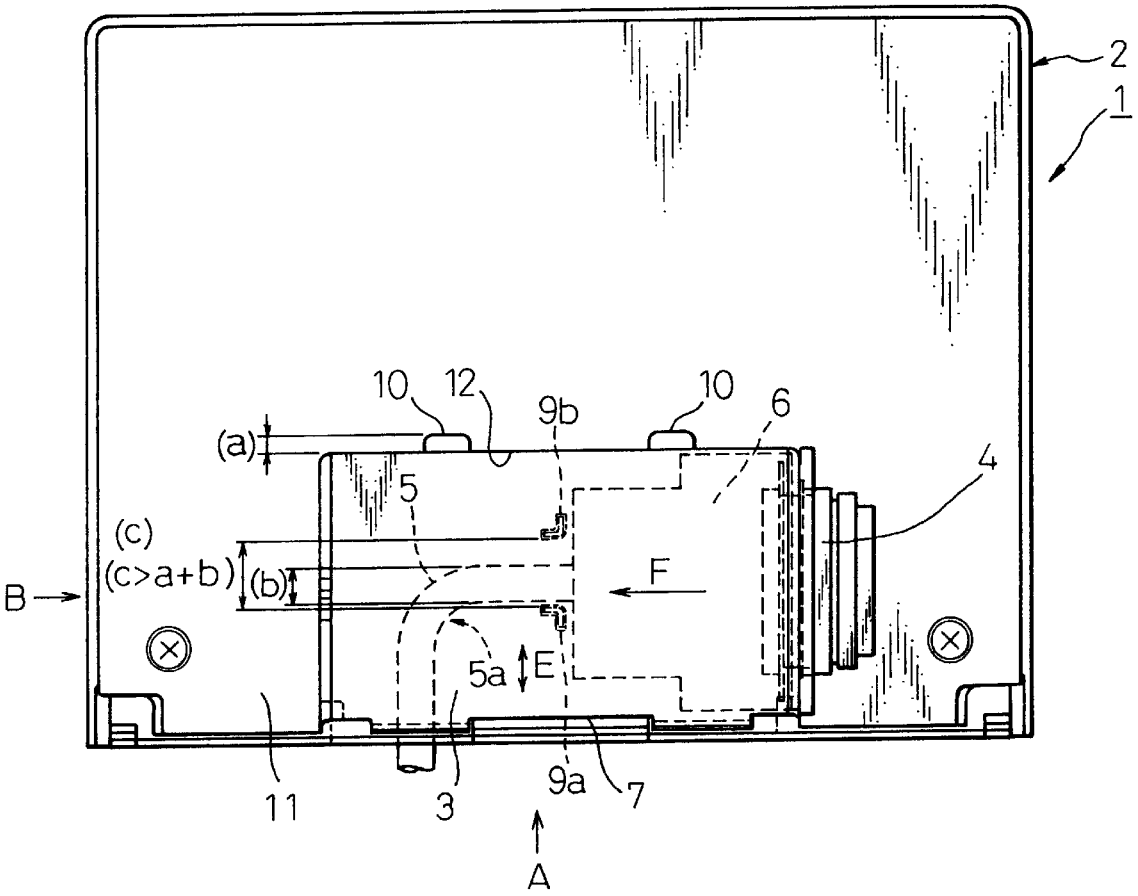
FIG. 1 is a schematic plan view of a bar-code reading apparatus having connector removal preventing means, particularly showing an interface section of the apparatus.
Figure 2:
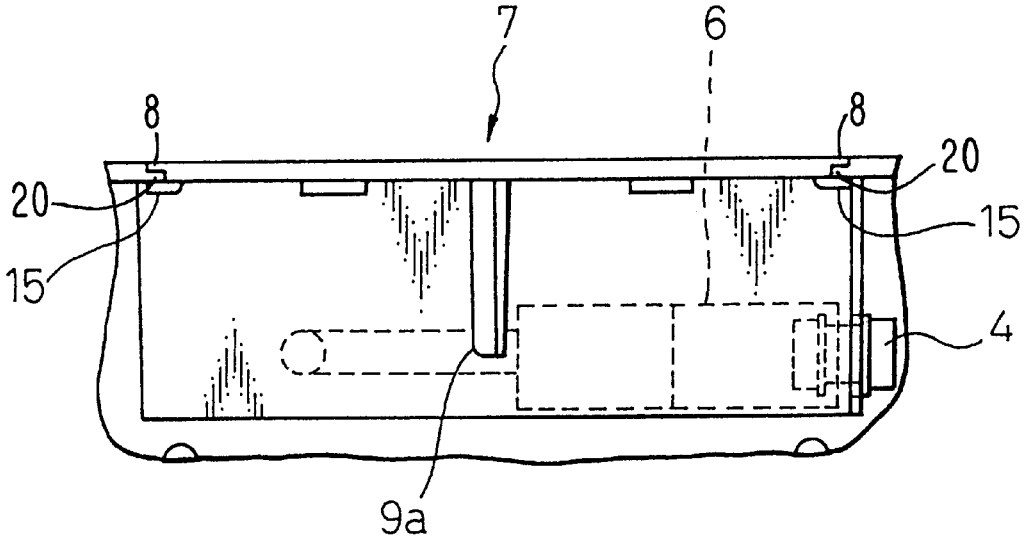
FIG. 2 is a partial front view of the bar-code reading apparatus seen from an arrow A in FIG. 1.

Embodiments of the present invention will now be described in detail with reference to the drawings.

Referring now to embodiments shown in FIGS. 1 to 6, the apparatus of the present invention can be an electronic apparatus, such as a computer, a bar-code scanner, a laser beam printer, or other similar apparatuses. The apparatus of the present invention can be applied to such an apparatus having an interface section for connecting a cable provided with a connector. Such an apparatus may have a plurality of interfaces. However, the description hereinafter relates a bar-code scanner having a single interface for the sake of explanation.

An apparatus body 2 of the bar-code scanner 1 is provided at an intermediate position of the upper side area (lower side in FIG. 1) with a housing 3 which constitutes an interface section. A connector 4 of the apparatus body side is fixedly attached to one of the walls (the right side wall seen in FIG. 1) of the apparatus body 1.

The cable 5 is provided at a distal end thereof with a connector 6 which can be engaged with the apparatus body side connector 4 by using the inside space of the housing 3 so as to conduct the communication of signals or the like. The cable 5 extending rearward from the connector 6 is bent in the housing 3 by about 90° and guide toward the outside of the housing 3. Therefore, the housing 3 is necessary to have a space to accommodate the connector 6 itself and the bent portion 5*a* of the cable 5.

A connector cover 1 is provided on the upper surface of the apparatus body so that the housing 3 can be opened and closed by the cover 1. Therefore, after the connector 6 is fitted to the connector 4 and the cable 5 is guided toward the outside of the housing 3, the housing 3 is closed by the connector cover 7.

Figure 7:
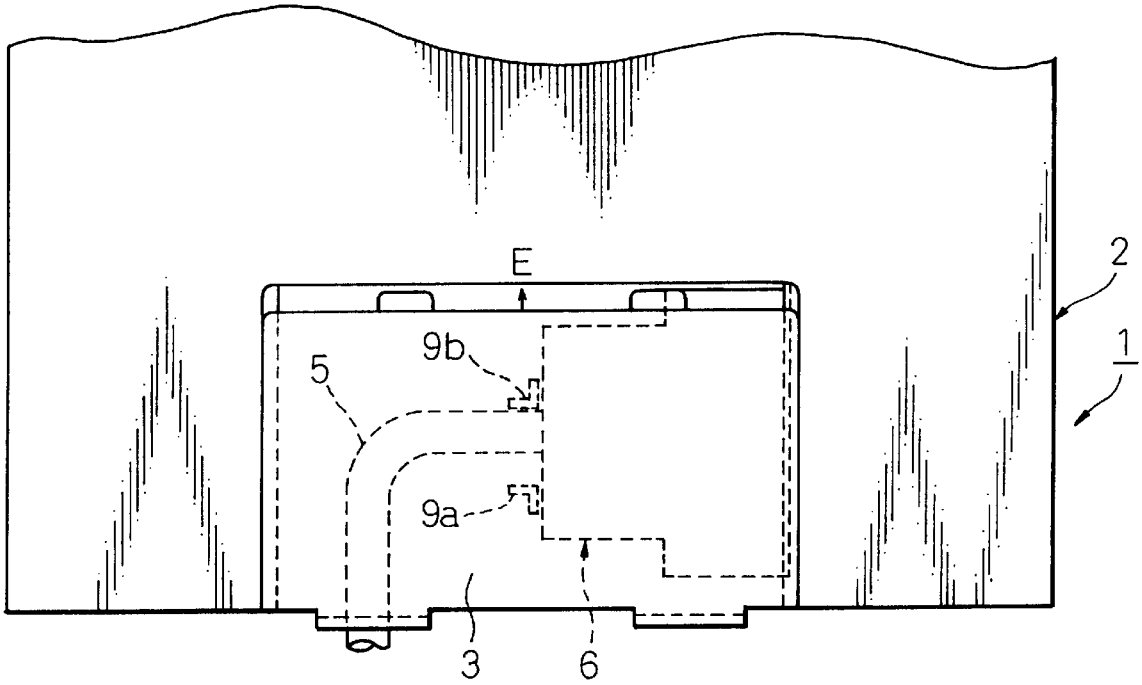
FIG. 7 shows the relationship of positions between the cable and projections when the connector cover is open.

The connector cover 7 has its right and left edges formed as sliding portions 8 which are guided along rails of the apparatus body and can be slidingly moved in the direction shown by an arrow E (FIGS. 3 and 7) within the range of a predetermined interval. In other words, the connector cover 7 can be slidingly moved in the direction shown by an arrow E from a first position at which the connector cover 7 can be attached to or removed from the apparatus body 1 and a second position at which the connector cover 7 is locked with respect to the apparatus body 1.

The connector cover 7 is provided with two projections 9*a* and 9*b* extending inward to the inside of the housing 3. It is preferable that these two projections 9*a* and 9*b* are located at the respective sides of the cable 5 of the connector 6 within the range of sliding movement of the connector cover 7 and spaced by a distance longer than the sum (a+b) of the diameter (b) of the cable 5 and an amount of sliding (a) of the connector cover 7 which is necessary to move the connector cover 7 from its closed position to its open position, without interference with the cable 5.

The reasons why the distance between the projections 9*a* and 9*b* is longer than a+b are that neither of these two projections 9*a* and 9*b* interferes with the cable 5 and the connector cover 7 can be fit with the housing 3 at any position within the range of sliding movement of the connector cover 7. If the distance between the projections 9*a* and 9*b* is not more than a+b, it should be necessary to fit the connector cover at an intermediate position within the range of sliding movement of the connector cover 7 so as not to interfere with the cable 5.

In case of the former, the operation of the connector cover is as follows. When the connector cover 7 is at the first position (FIG. 7), two extensions 10 formed at the front edge of the connector cover 7 pass near the opening edge 12 (FIGS. 1 and 3) of the upper cover 11 of the apparatus body 1 to fit the respective edges of the connector cover 7 with the rails of the apparatus body. At this position, the connector cover 7 is pushed in the direction shown by an arrow E to bring the connector cover 7 to the second position, the two extensions 10 come into be engaged with the back surface of the upper cover 11.

Figure 3:
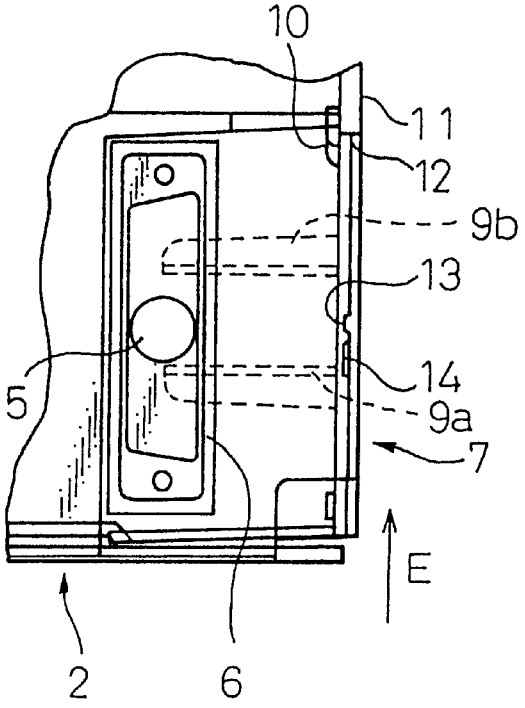
FIG. 3 is a partial side view, partially cross-section, of the bar-code reading apparatus seen from an arrow B in FIG. 1.
Figure 4:
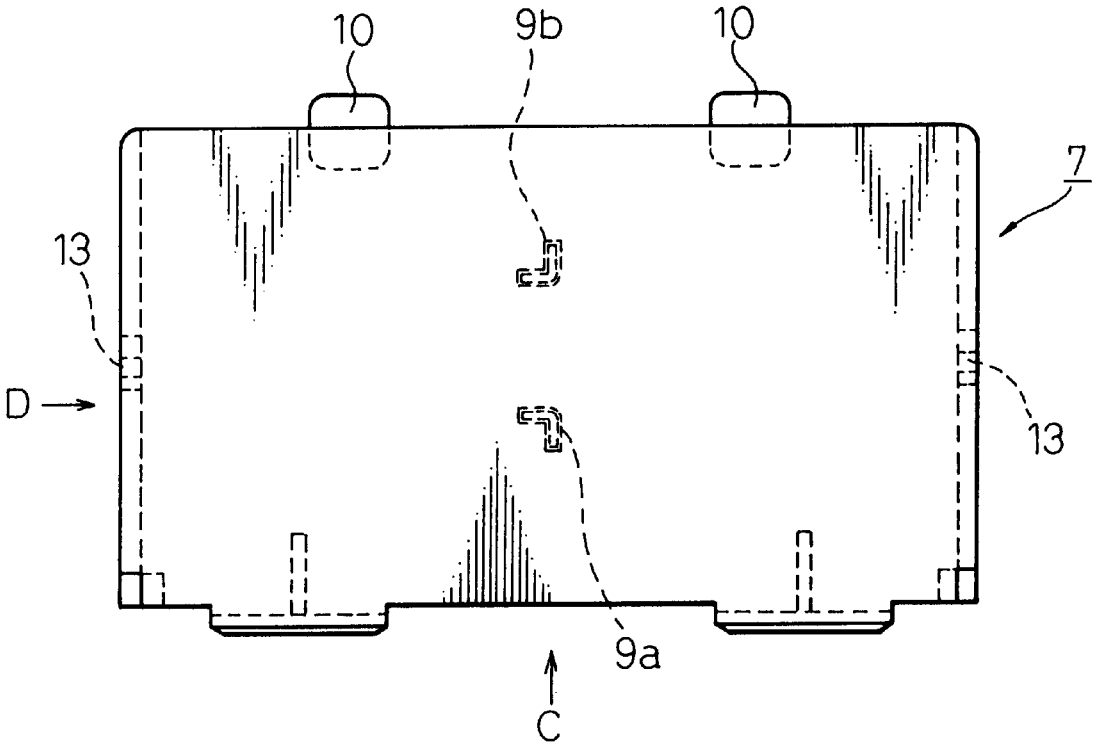
FIG. 4 is a plan view showing a connector cover.
Figure 5:
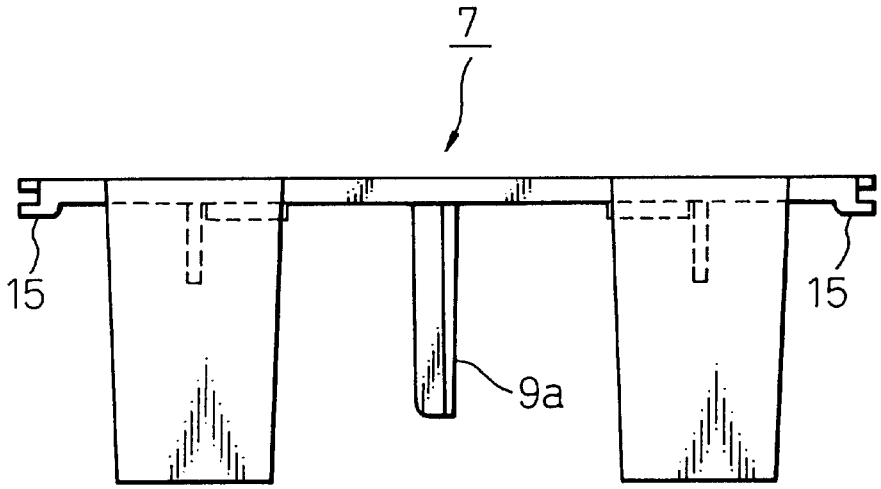
FIG. 5 is a front view of the connector cover seen from an arrow C in FIG. 4.
Figure 6:
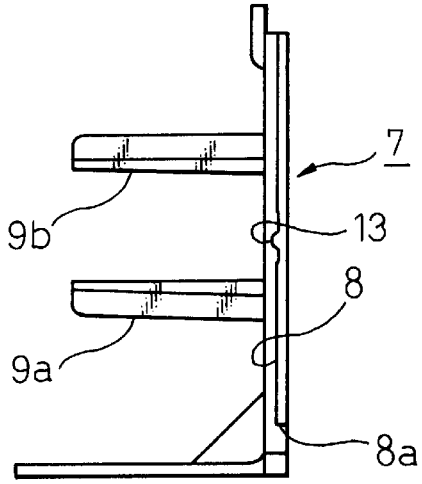
FIG. 6 is a side view of the connector cover seen from an arrow D in FIG. 4.

On the other hand, the connector cover 7 is provided at its respective sliding portions 8 with respective projections 13 which pass over ridges 14 (FIG. 3) provided on the rails of the apparatus body 1. Thus, the projections 13 are engaged with one ends of these ridges 14 and, therefore, the connector cover 7 is locked at the second (closed) position. Therefore, when the lock is to be released, the connector cover 7 should be drawn to the direction opposite to the arrow E (FIG. 3). Thus, the projections 13 will be able to come over the ridges 14 and move toward the first position.

The sliding direction E (FIG. 3) of the connector cover 7 and the inserting direction F (FIG. 1) of the cable side connector 6 with respect to the body side connector 4 are perpendicular to each other. Also, the two projections 9*a* and 9*b* of the connector cover 7 are located at the respective side of the cable 5 in the vicinity of the rear portion of the connector 6. Thus, any unintentional removal of the connector 6 is prevented.

More particularly, in the closed position of the connector cover 7, if the connector 6 is to be moved to the direction F, the rear portion of the connector 6 comes into contact with the projections 9*a* and 9*b* which restrict the connector 6 so as not to move any more and removal of the connector 6 is thus prevented.

In the complete fitting condition of the connector 6, the distance between the rear portion of the connector 6 and projections 9*a* and 9*b* is such a width that the electrical connection between the connectors 4 and 6 is not to be released. Therefore, even if the connector 6 moves to the position of the projections 9*a* and 9*b*, the electrical contact between the connectors 4 and 6 is kept with respect to each other.

Contrary to this, under the condition that the connector 6 is disconnected, the distal ends of the projections 9*a* and 9*b* come in touch with the connector 6 and thus the connector cover 7 cannot be closed. The reason is that, as mentioned above, under the condition that the connector 6 is completely be engaged, the projections 9*a* and 9*b* are located at the position near to or in contact with the rear portion of the connector 6.

When the connector cover 7 is in a first position within its sliding range, one 9*a* of the projections is positioned near to the one side of the cable 5 (lower side in FIG. 1) and, when the connector cover 7 is in a second position, the other projection 9*b* is positioned near to the other side of the cable 5 (upper side in FIG. 1).

If the connector cover 7 is moved from the second position to the first position, as mentioned above, the projections 13 come over the ridges 14 and come to the other sides of the ridges 14, end edge (FIG. 6) of the respective sides of the connector cover 7 come into contact with the wall of the apparatus body so as to function as a stopper. Contrary to this, if the connector cover 7 is moved from the first position to the second position, the extensions 10 at the front end of the connector cover 7 come to be engaged with the back side the upper cover of the apparatus body, as mentioned above, and the hooks 15 (FIGS. 2 and 15) at the rear end of the connector cover 7 come to be engaged with the slide rails 8 (FIG. 2) of the apparatus body to keep the connector cover 7 in its locked position, as shown in FIG. 2.

It should be noted that the gap between two projections 9*a* and 9*b* is smaller than the width (i.e. the minimum width) of the connector 6, since if the gap was larger than the latter, it would not be possible to keep the connector 6 in an engaged condition with the apparatus side connector 4.

It is preferable that the connector cover 7 is unitary made of elastic material, such as resin or the like, for example, ABS resin. Thus, the connector cover 7 has a suitable flexibility and, therefore, the snap locking of the connector cover 7 can effectively be carried out at the second position thereof.

The foregoing description relates to only a preferred embodiment of the disclosed invention, it should be understood by those skilled in the art that and that various changes and modifications may be made to the invention without departing from the spirit and scope thereof.

Some of the modifications of this invention will be described below.

(1) In the above-mentioned embodiment, although the direction of sliding of the connector cover 7 is different from (perpendicular to) the inserting/disengaging direction of the connector 6, these directions may be same. However, in this case, it is preferable that the connector cover has such a structure not to be easily removed.

(2) In the above-mentioned embodiment, although the cable 5 is bent by about 90°, the cable 5 may not be bent, but be remained straight, if it is allowed by the structure and position of the housing 3.

(3) In addition, in the above-mentioned embodiment, although the projections 9*a* and 9*b* extend perpendicularly to the moving direction of the connector cover 7, the direction along which the projections 9*a* and 9*b* extend may be the same as the sliding direction of the connector cover 7.

What is claimed is:

1. An electronic apparatus, comprising:

an apparatus body;

a first connector, fixed to said apparatus body, with which a second connector, attached to a cable, is to be engaged by movement of the second connector in a first direction relatively to, and by insertion thereof into, the first connector;

a connector housing provided in said apparatus body and having a wall to which said first connector is installed and a space accommodating therein the second connector, as inserted into the first connector;

a connector cover closing said housing, the connector cover having projections protruding therefrom in a second direction, different from the first direction, preventing movement of the second connector in a direction, opposite to the first direction and tending to disengage the second connector from the first connector; and said connector cover is slidingly movable in a third direction, different from the first and second directions, between a first, opened position in which the connector cover is removable from the apparatus body and wherein said second connector can be removed from and inserted into said connector housing to be engaged with said first connector, and a second, closed position in which said connector cover is locked to the apparatus body.

2. An apparatus as set forth in claim 1, wherein said connector cover is provided with at least two said projections which are located at respective sides of said cable and spaced to each other by a distance larger than a sum of a diameter of said cable and a sliding width of said connector cover necessary for opening said connector cover.

3. An apparatus as set forth in claim 2, wherein said connector cover has at least two said projections, spaced-apart by a distance, larger than a sum of a diameter of said cable and a sliding distance of said connector cover necessary for sliding the connector cover between the opened and closed positions thereof, and disposed so as to be located at respective, opposite sides of said cable.

4. An apparatus as set forth in claim 2, wherein the connector cover is elastically snap-locked when moved to the second, closed position and the connector cover is movable from the second, closed position to the first, opened position by forcedly moving said connector cover against the elastical snap locking.

5. An electronic apparatus as set forth in claim 2, wherein:

a first, second and third directions are respectively and substantially mutually perpendicular.

6. An electronic apparatus, comprising:

a first connector;

a connector housing, to which said first connector is attached, accommodating therein a second connector having a cable extending from a rear surface thereof and having an engaging forward end which is to be inserted into, and thereby connected to, the first connector by an engaging movement of the second connector in a first direction relatively to the first connector;

a connector cover slidingly movable in parallel in a second direction, different from the first direction, between an opened position opening the connector housing, wherein said second connector can be removed from and inserted into said connector housing to be engaged with said first connector, and a closed position closing and releasably locked to said connector housing; and the connector cover having spaced projections extending therefrom in a third direction, different from the first and second directions, disposed adjacent the rear surface of the second connector while not interfering with the cable and thereby opposing a disengaging movement of the second connector, opposite to the engaging movement, along the first direction relative to the first connector.

7. An apparatus as set forth in claim 6, wherein said connector cover has at least two said projections spaced-apart by a distance, larger than a sum of a diameter of said cable and a sliding distance of said connector cover necessary for sliding the connector cover between the opened and closed positions thereof, and disposed so as to be located at respective, opposite sides of said cable.

8. An apparatus as set forth in claim 7, wherein the connector cover is elastically snap-locked when moved to the second, closed position and the connector cover is movable from the second, closed position to the first, opened position by forcedly moving said connector cover against the elastical snap locking.

9. An apparatus as set forth in claim 8, wherein:

the apparatus body is provided with rails for slidingly supporting respective side edges of said connector cover; and the connector cover is provided with projections and the rails are provided with ridges such that the projections ride resiliently over the ridges, respectively, and are thereby snap locked in place behind the ridges, locking the connector cover at the second, closed position and, when the connector cover is forcedly moved toward the first position, the projections ride resiliently over the ridges to allow the connector cover to move to the first, opened position.

10. An electronic apparatus as set forth in claim 6, wherein:

a first, second and third directions are respectively and substantially mutually perpendicular.

* * * * *